US006498857B1

(12) United States Patent
Sibbald

(10) Patent No.: US 6,498,857 B1
(45) Date of Patent: Dec. 24, 2002

(54) METHOD OF SYNTHESIZING AN AUDIO SIGNAL

(75) Inventor: Alastair Sibbald, Maidenhead (GB)

(73) Assignee: Central Research Laboratories Limited, Hayes (GB)

( * ) Notice: Subject to any disclaimer, the term of this patent is extended or adjusted under 35 U.S.C. 154(b) by 0 days.

(21) Appl. No.: 09/335,759

(22) Filed: Jun. 18, 1999

(30) Foreign Application Priority Data

Jun. 20, 1998 (GB) ..... 9813290

(51) Int. Cl.[7] ..... H04R 5/02

(52) U.S. Cl. ..... 381/310; 381/1; 381/17; 381/309

(58) Field of Search ..... 381/1, 17, 18, 381/19, 310, 20, 21, 22, 23, 309, 61, 63

(56) References Cited

U.S. PATENT DOCUMENTS 5,105,462 A * 4/1992 Lowe et al. ..... 381/17
5,371,799 A 12/1994 Lowe ..... 381/17
5,467,401 A * 11/1995 Nagamitsu et al. ..... 381/63
5,581,618 A * 12/1996 Satoshi et al. ..... 381/17
5,666,425 A * 9/1997 Sibbald et al. ..... 381/26
5,822,438 A * 10/1998 Sekine et al. ..... 381/17
5,946,400 A * 8/1999 Matsuo ..... 381/17
6,259,795 B1 * 7/2001 McGrath ..... 381/310
6,307,941 B1 * 10/2001 Tanner, Jr. et al. ..... 381/17

FOREIGN PATENT DOCUMENTS

EP 0 357 402 A2 3/1990
GB 2 276 298 9/1994
WO WO 94/24836 10/1994

* cited by examiner

*Primary Examiner*—Xu Mei
(74) *Attorney, Agent, or Firm*—William H. Bollman

(57) ABSTRACT

A method of synthesizing an audio signal having left and right channels corresponding to an extended virtual sound source at a given apparent location in space relative to a preferred position of a listener in use is described. The information in the channels includes cues for perception of the direction of said virtual sound source from the preferred position. The extended source comprises a plurality of point virtual sources, the sound from each point source being spatially related to the sound from the other point sources, such that sound appears to be emnitted from an extended region of space. If the signal from two sound sources is the same, they are modified to be sufficiently different from one another to be separately distinguishable by a listener when they are disposed symmetrically on either side of the listener. This modification can be accomplished by filtering the two point sources using different comb filters.

15 Claims, 15 Drawing Sheets

METHOD OF SYNTHESIZING AN AUDIO SIGNAL

This application is related to and claims priority from a British Patent Application No. 9813290.5 filed Jun. 20, 1998, and entitled "A METHOD OF SYNTHESIZING AN AUDIO SIGNAL", the entirety of which is explicitly incorporated herein by reference.

This invention relates to a method of synthesizing an audio signal having left and right channels corresponding to a virtual sound source at a given apparent location in space relative to a preferred position of a listener in use, the information in the channels including cues for perception of the direction of said virtual sound source from said preferred position.

The processing of audio signals to reproduce a three dimensional sound-field on replay to a listener having two ears has been a goal for inventors since the invention of stereo by Alan Blumlein in the 1930's. One approach has been to use many sound reproduction channels to surround the listener with a multiplicity of sound sources such as loudspeakers. Another approach has been to use a dummy head having microphones positioned in the auditory canals of artificial ears to make sound recordings for headphone listening. An especially promising approach to the binaural synthesis of such a sound-field has been described in EP-B-0689756, which describes the synthesis of a sound-field using a pair of loudspeakers and only two signal channels, the sound-field nevertheless having directional information allowing a listener to perceive sound sources appearing to lie anywhere on a sphere surrounding the head of a listener placed at the centre of the sphere.

A drawback with such systems developed in the past has been that although the recreated sound-field has directional information, it has been difficult to recreate the perception of having a sound source which is perceived to move towards or away from a listener with time, or that of a physically large sound source.

According to a first aspect of the invention there is provided a method as specified in claims 1–11. According to a second aspect of the invention there is provided apparatus as specified in claim 12. According to a third aspect of the invention there is provided an audio signal as specified in claim 13.

It might be argued that to synthesize a large area sound source one might use a large area source for a particular HRTF measurement. However, if a large loudspeaker is used for the HRTF measurements, then the results are gross and imprecise. The measured HRTF amplitude characteristics become meaningless, because they are effectively the averaged surmmation of many. In addition, it becomes impossible to determine a precise value for the inter-aural time-delay element of the HRTF (FIG. 1), which is a critical parameter. The results are therefore spatially vague, and cannot be used to create distinctly distinguishable virtual sources.

Figure 1:
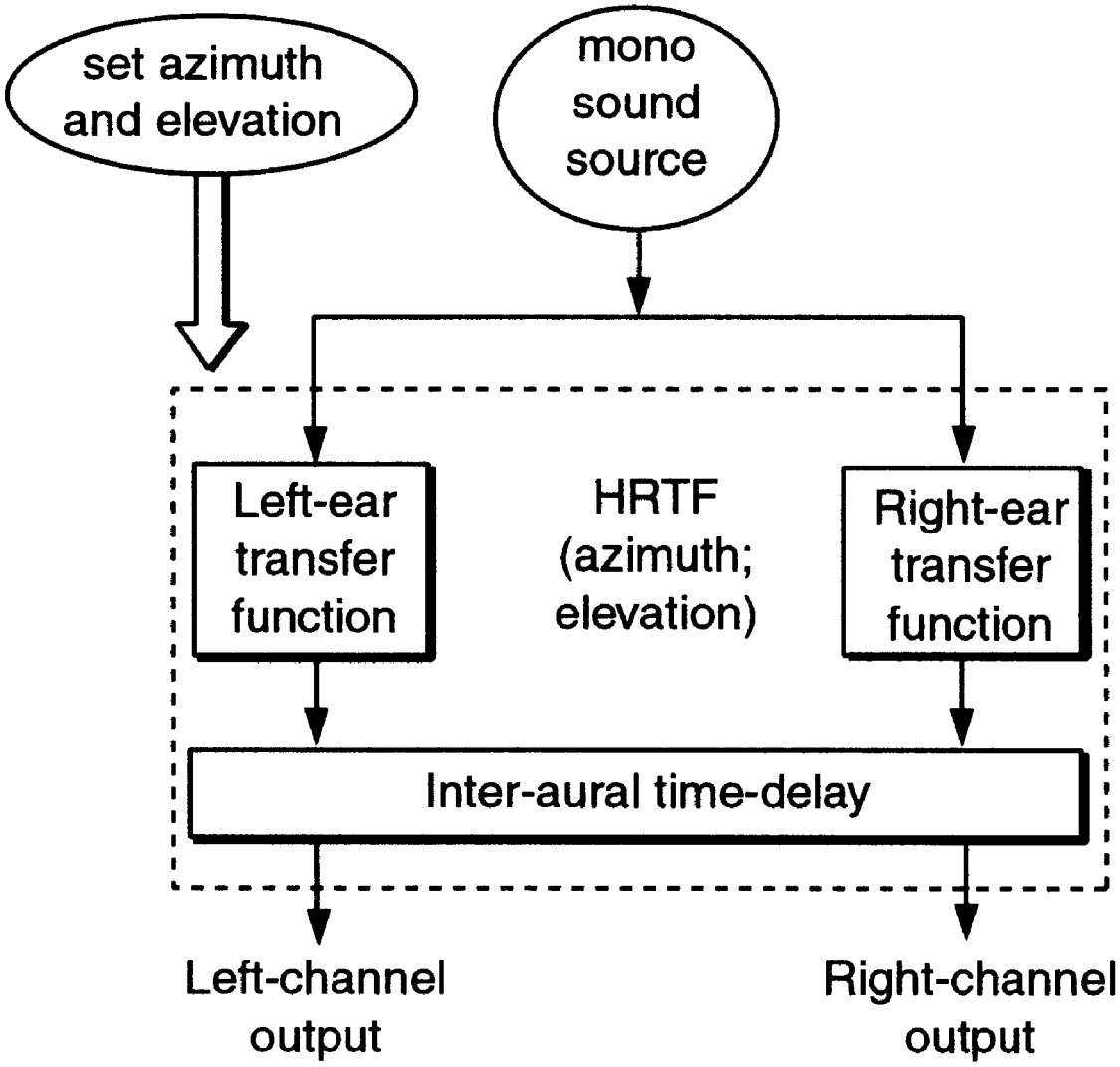
Figure 2:
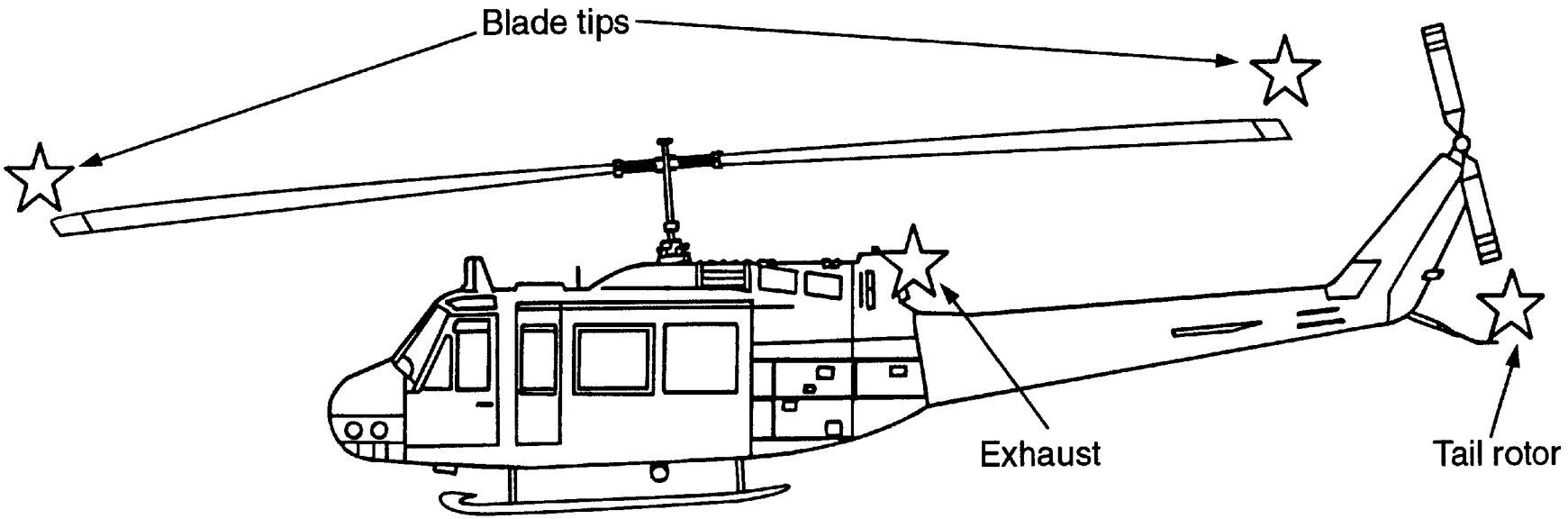
Figure 3:
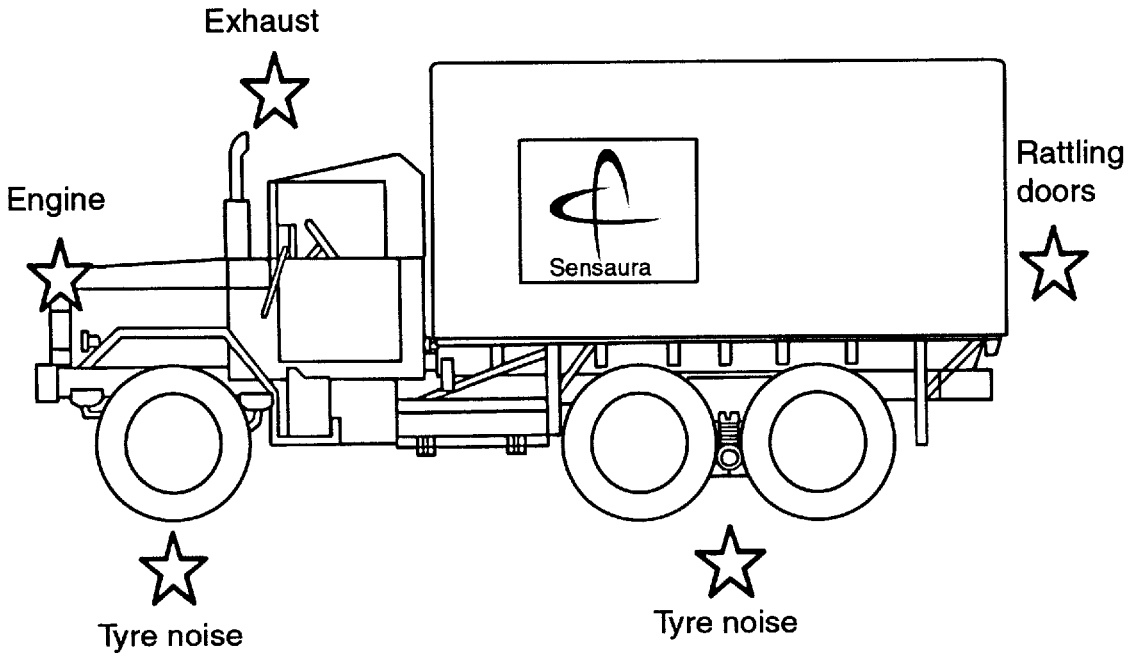
Figure 4A:
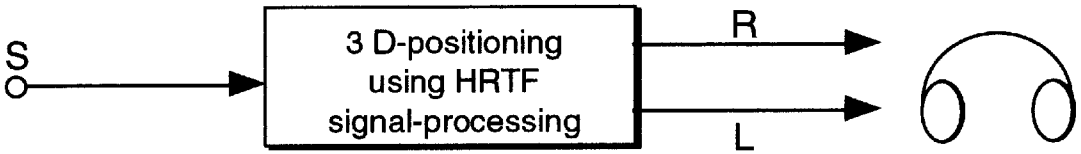
Figure 4B:
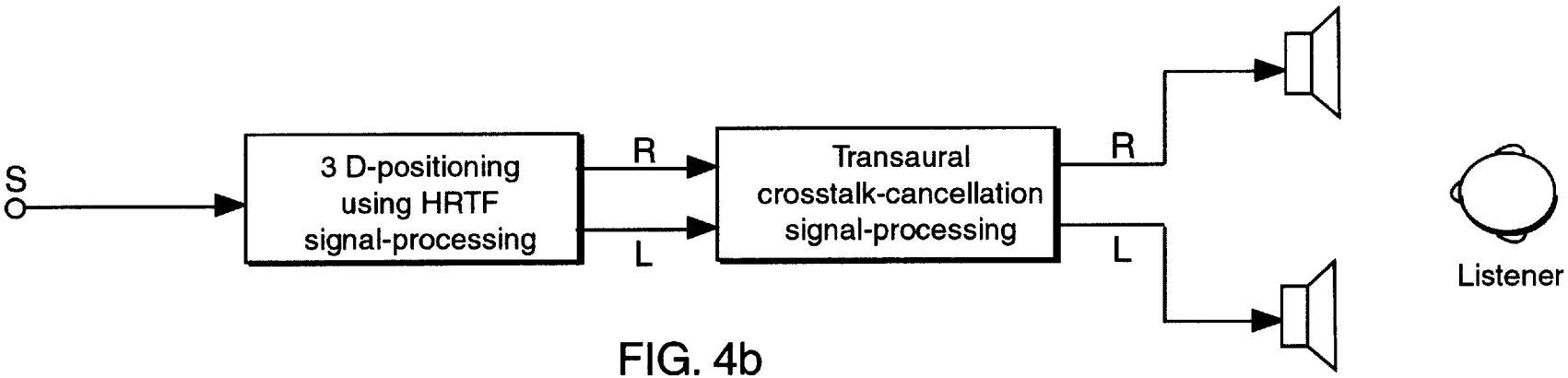
Figure 5:
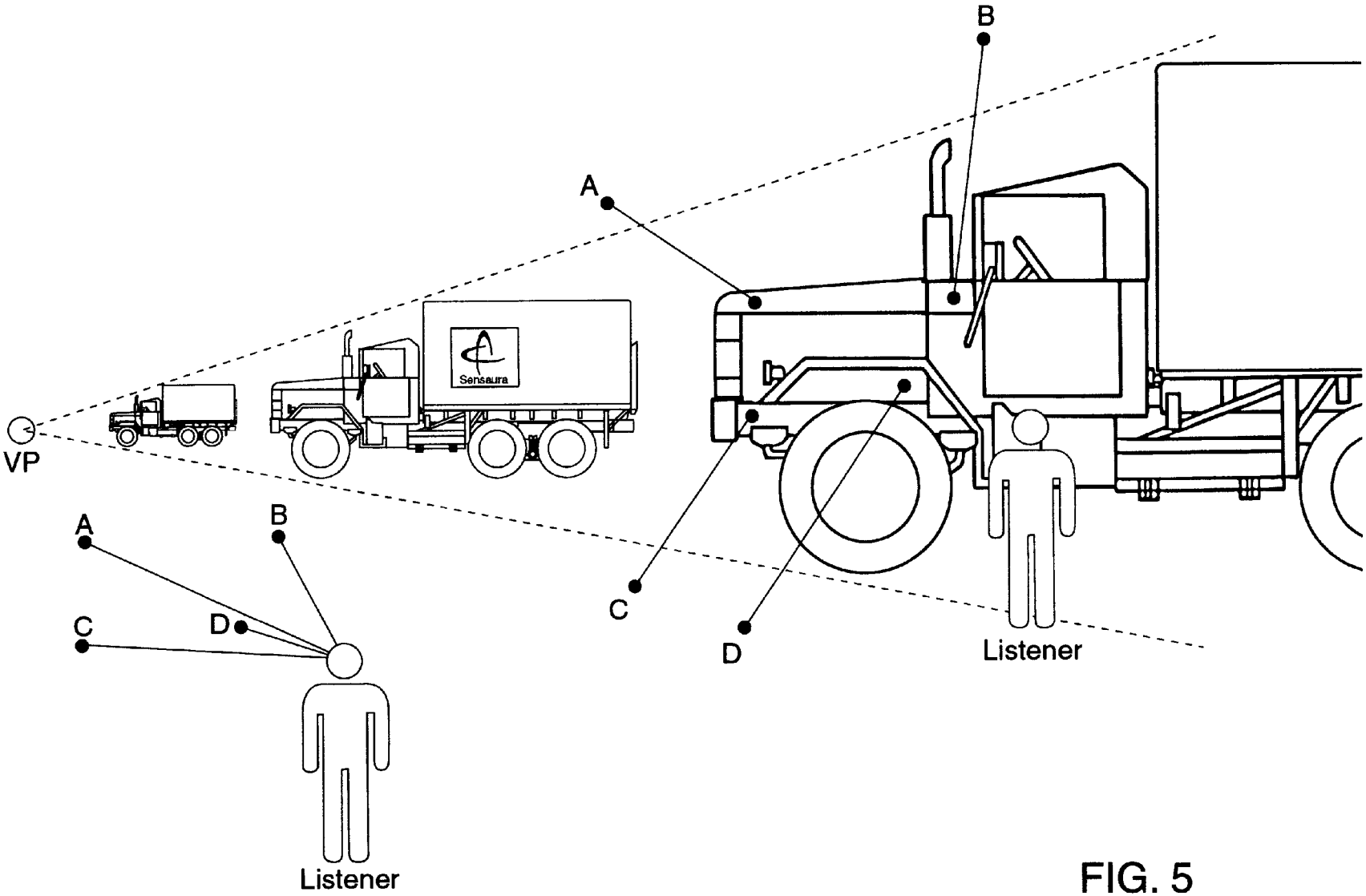
Figure 6:
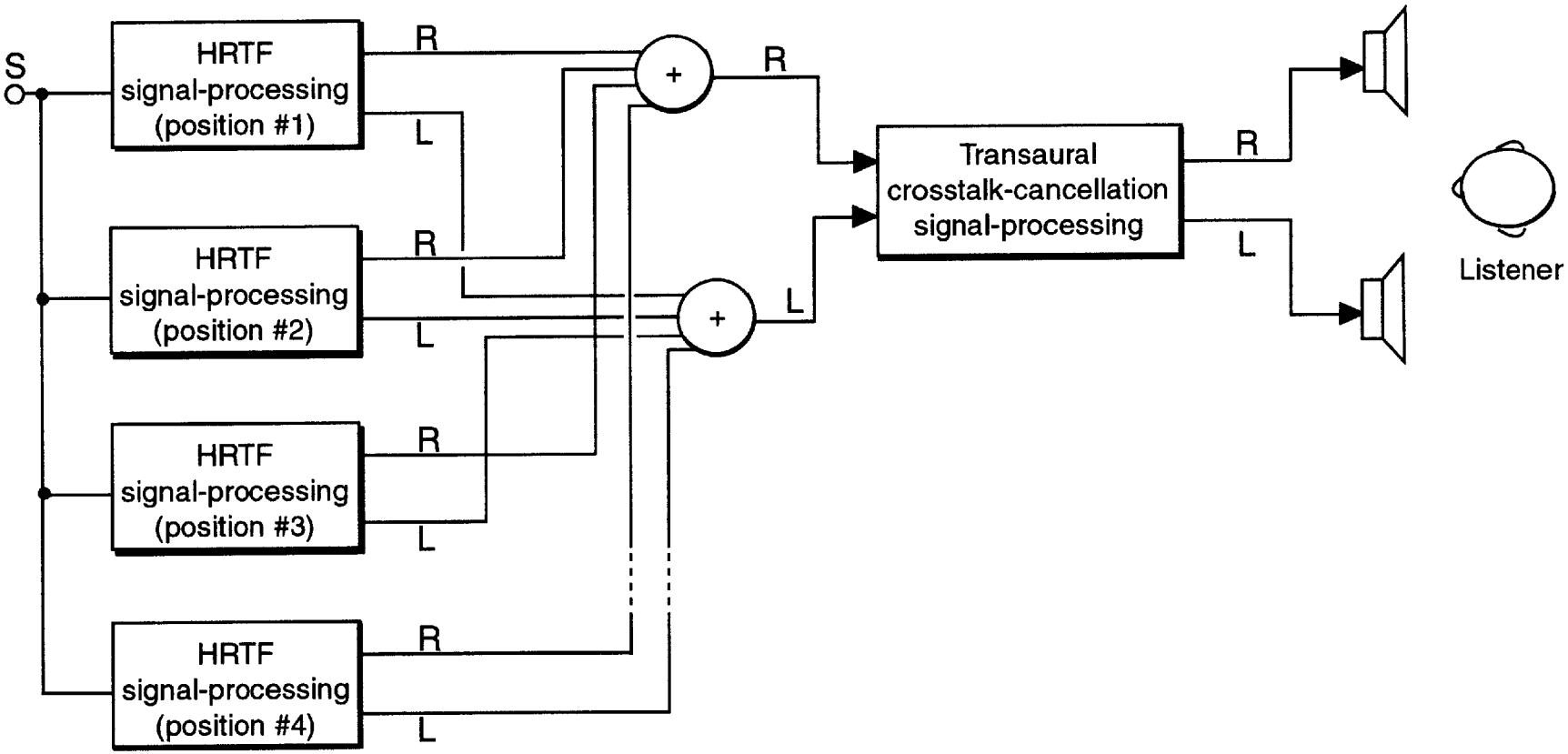
Figure 7:
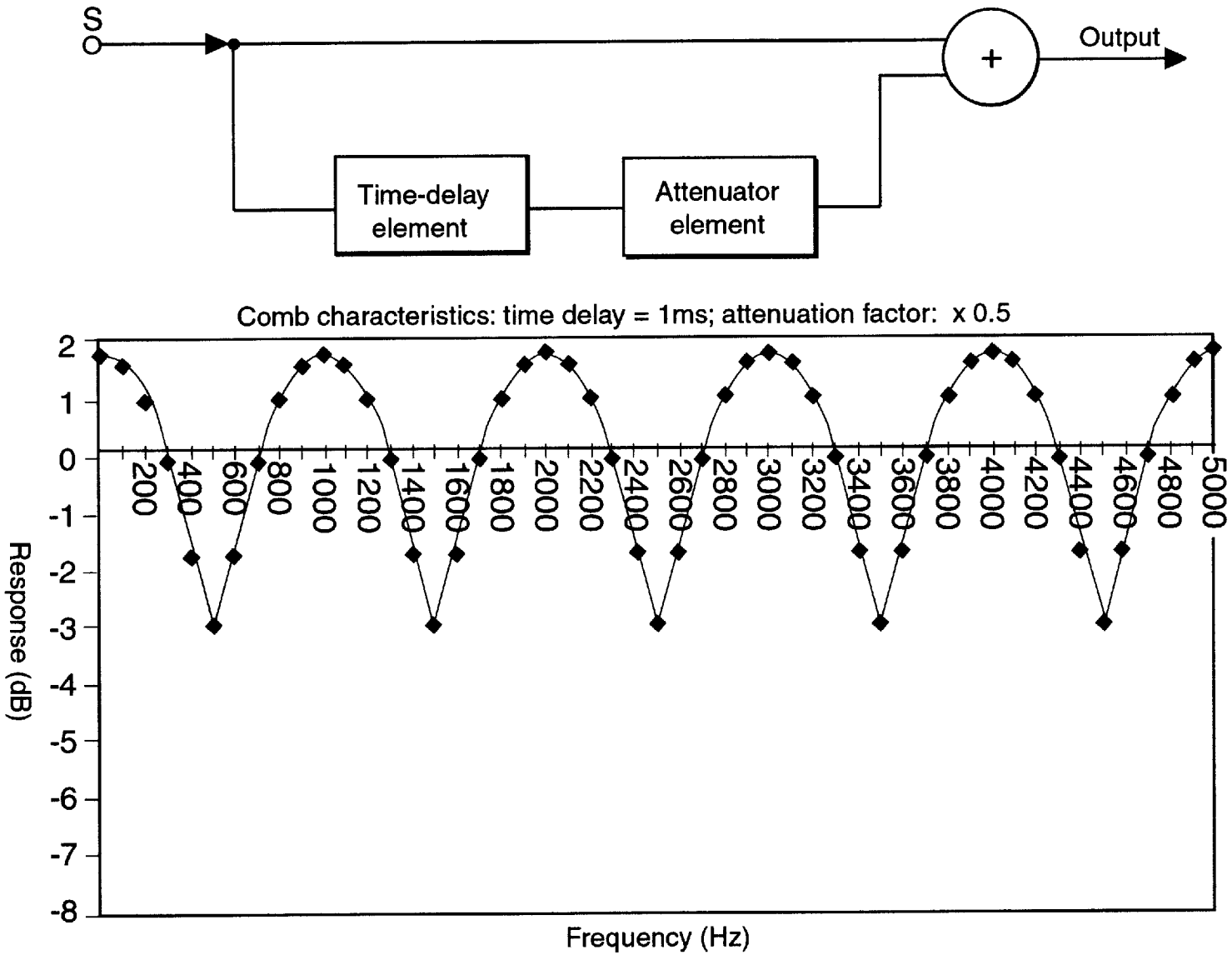
Figure 8:
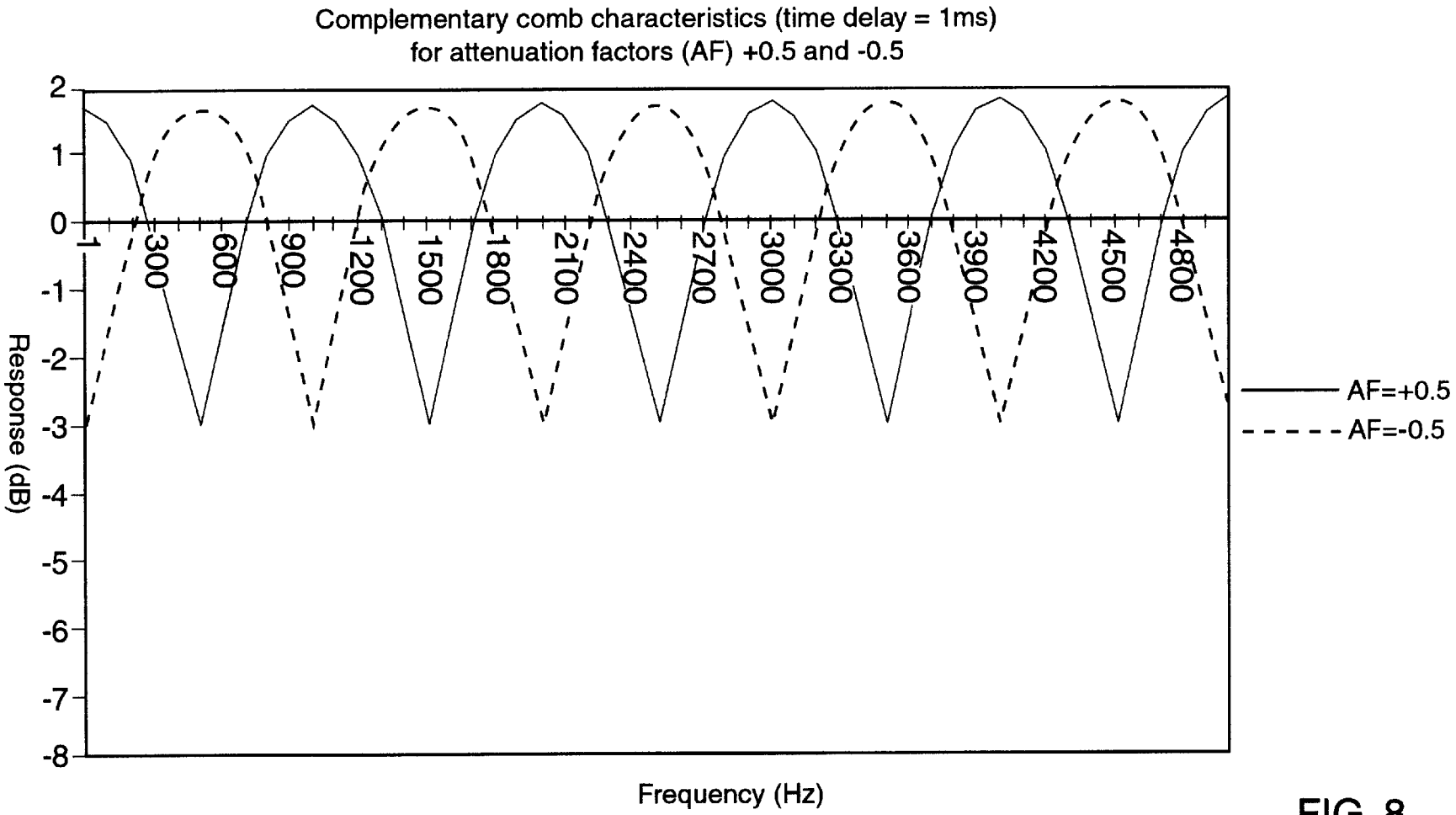
Figure 9:
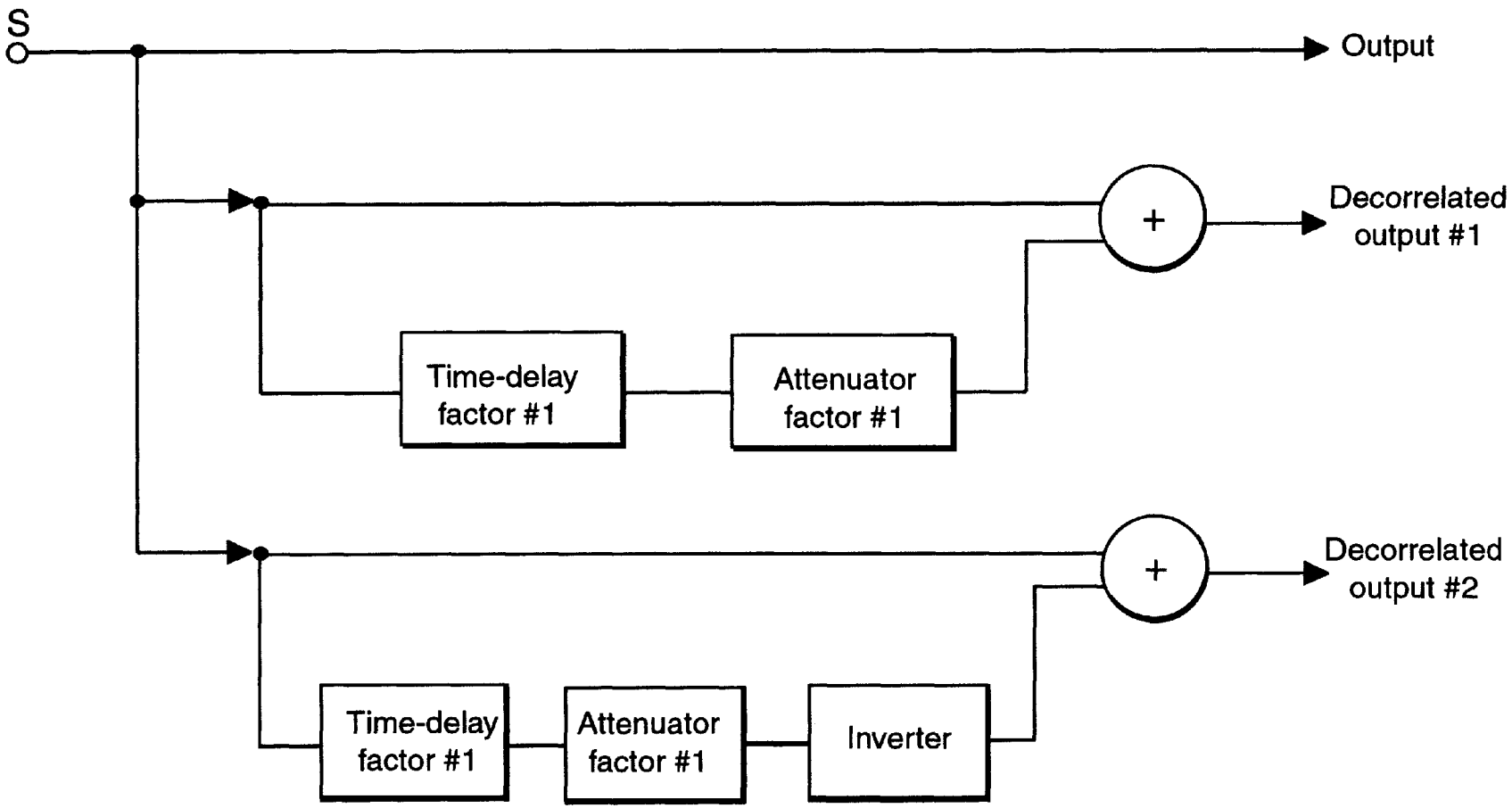
Figure 10:
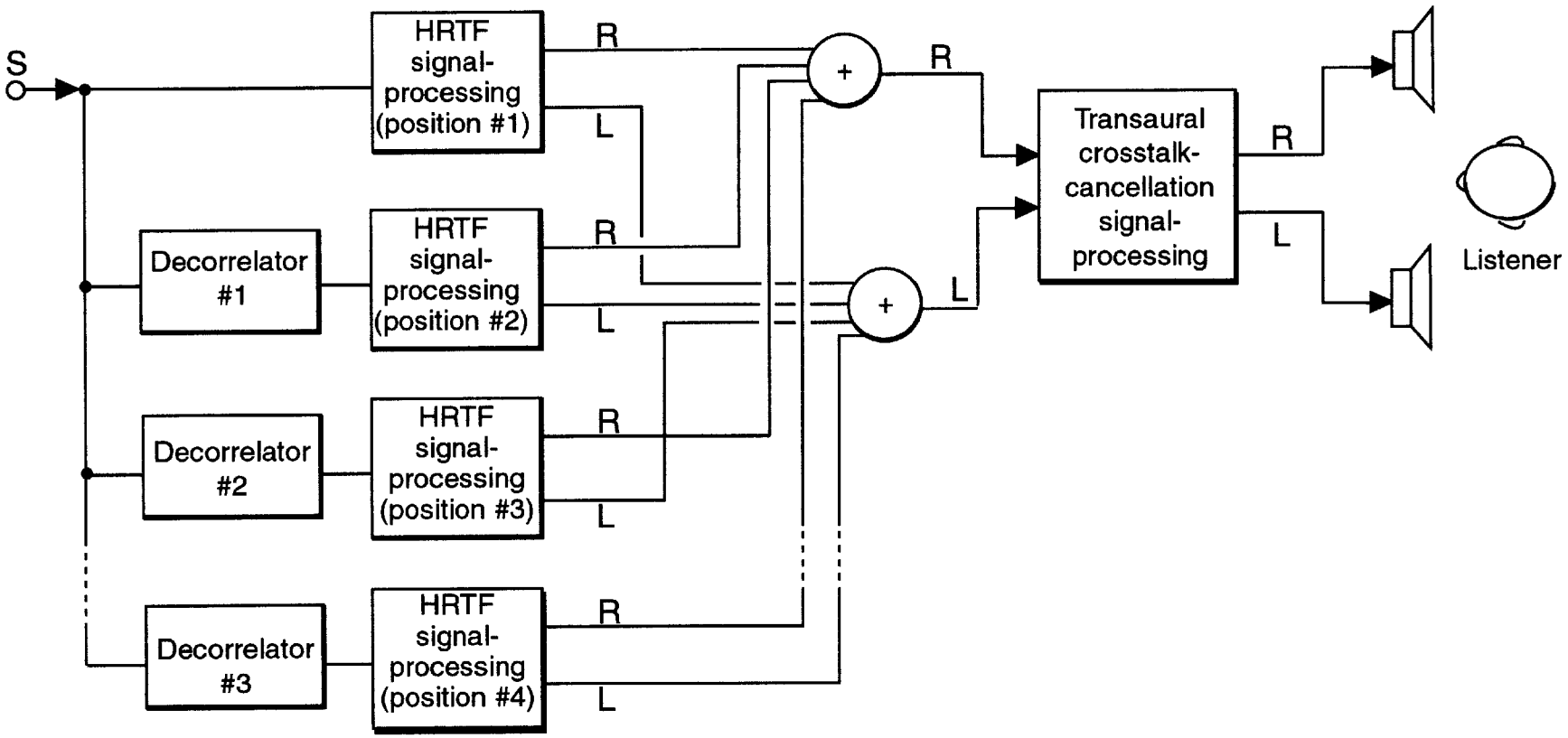
Figure 11:
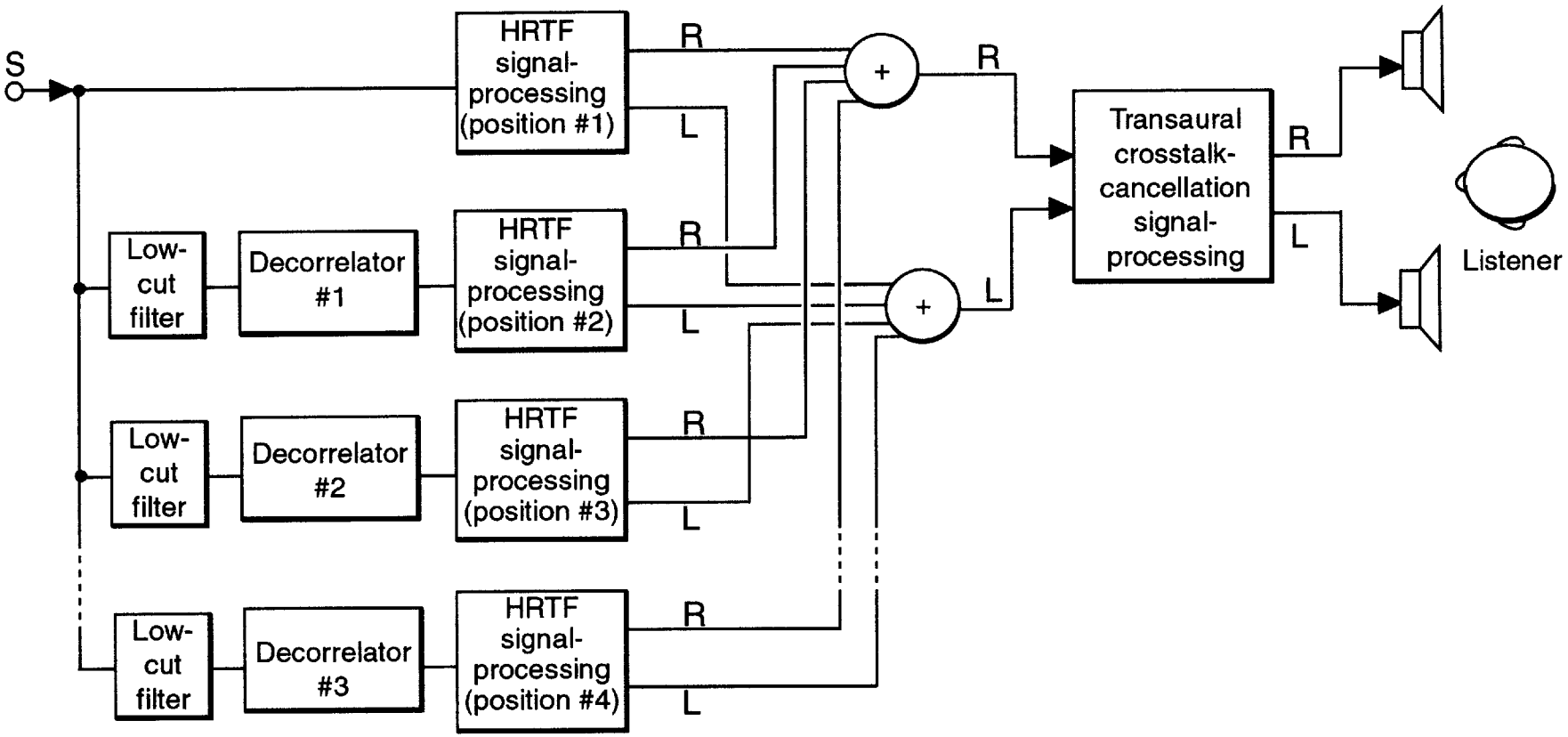
Figure 12:
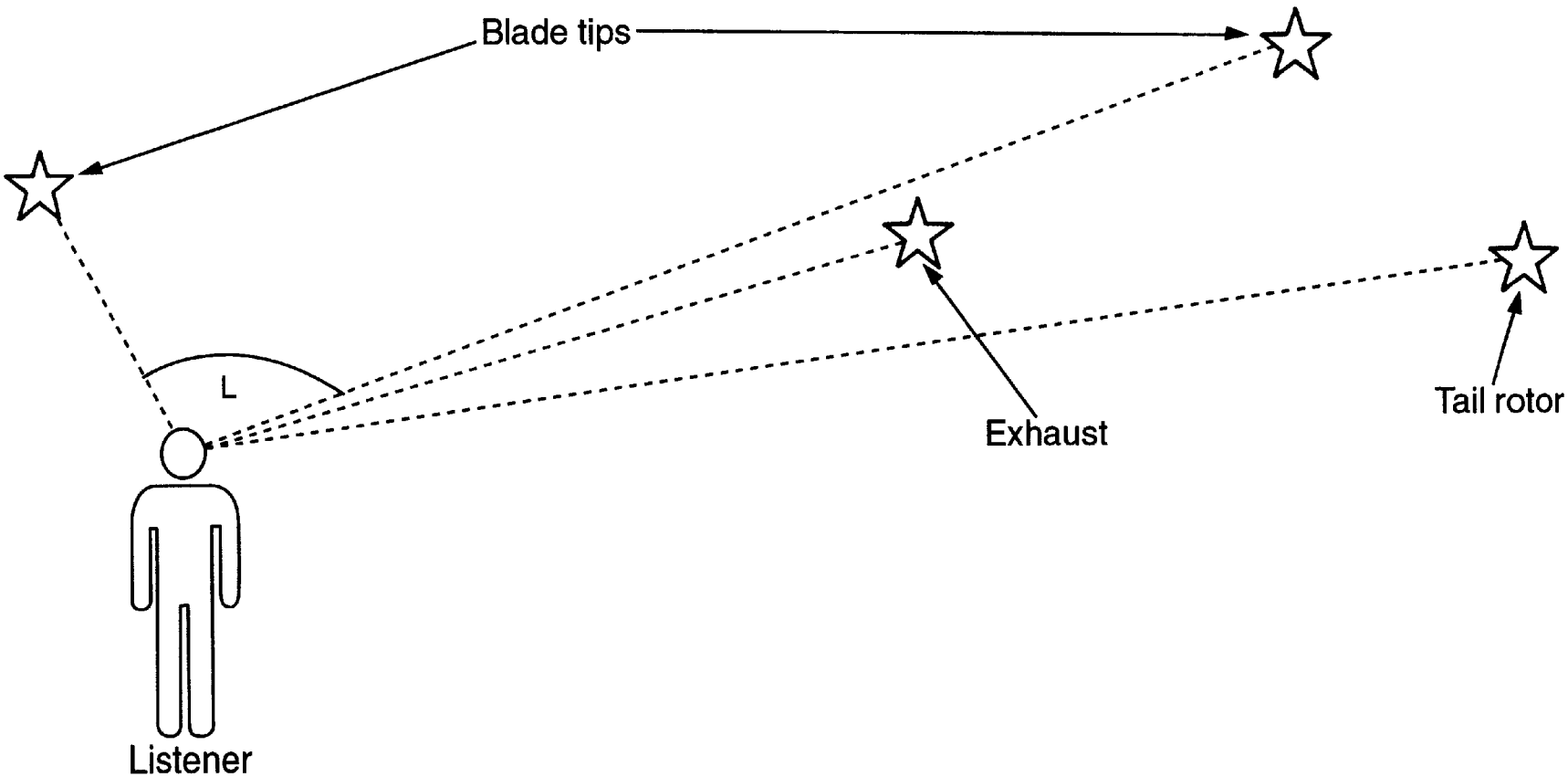
Figure 13:
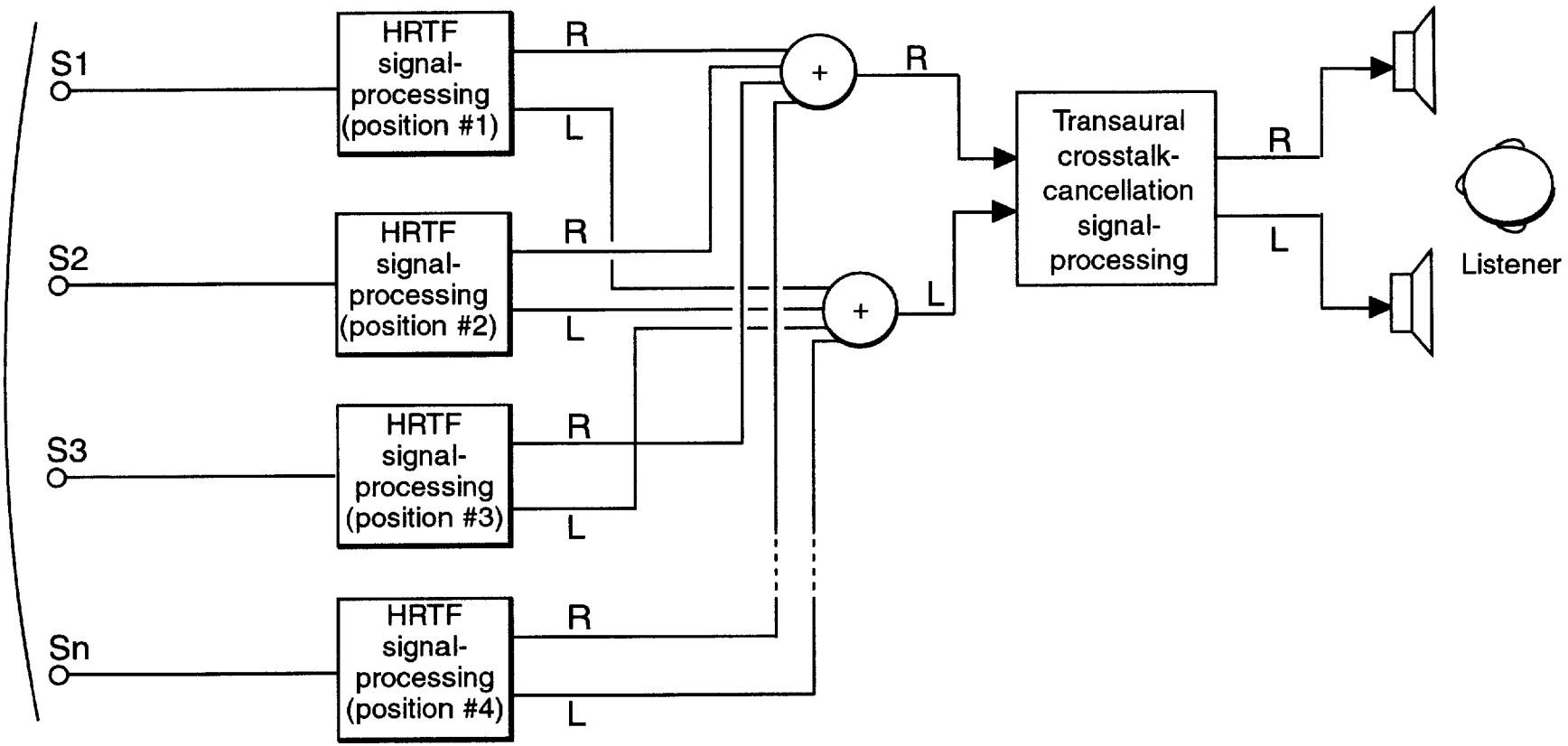
Figure 14:
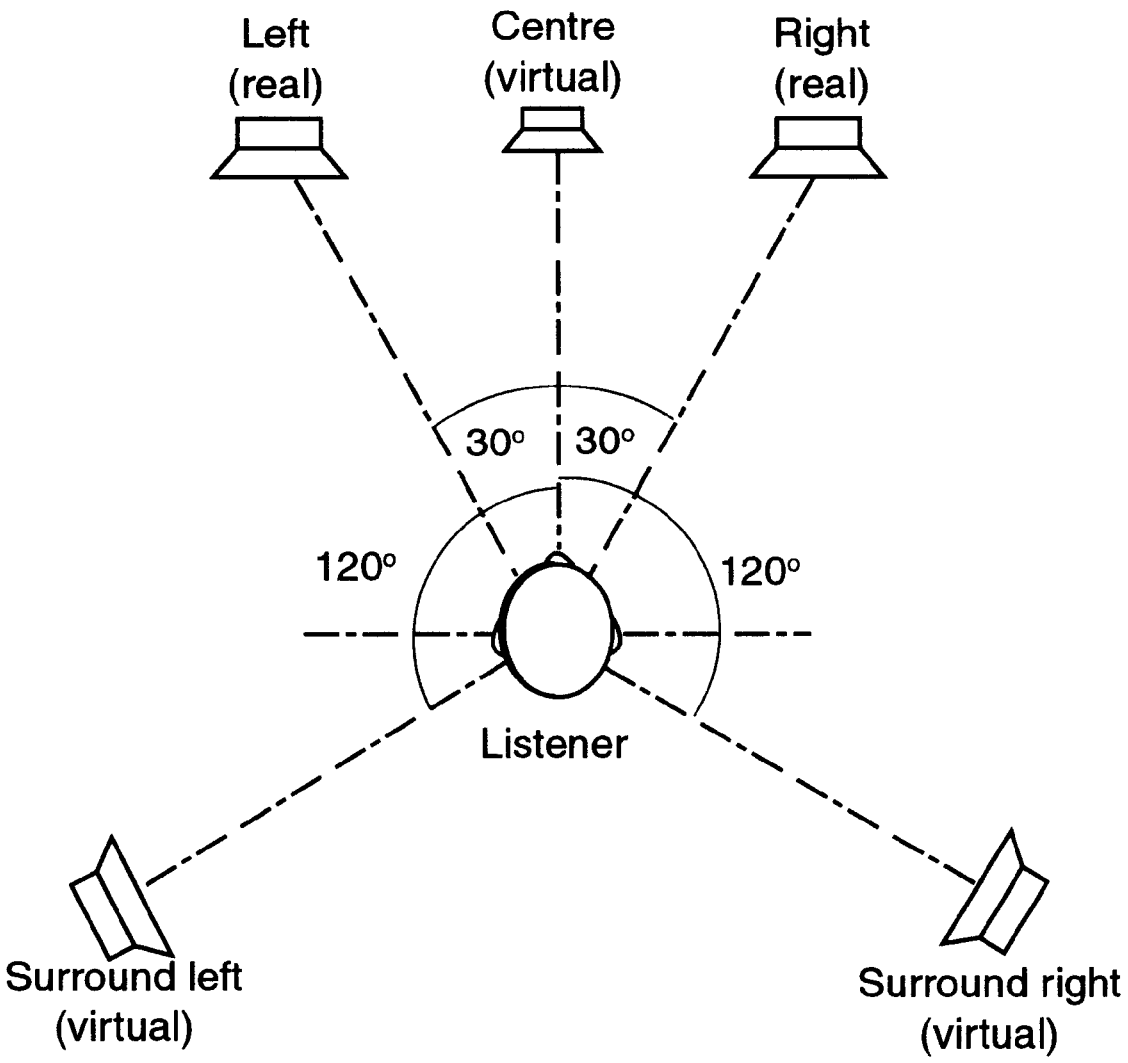
Figure 15:
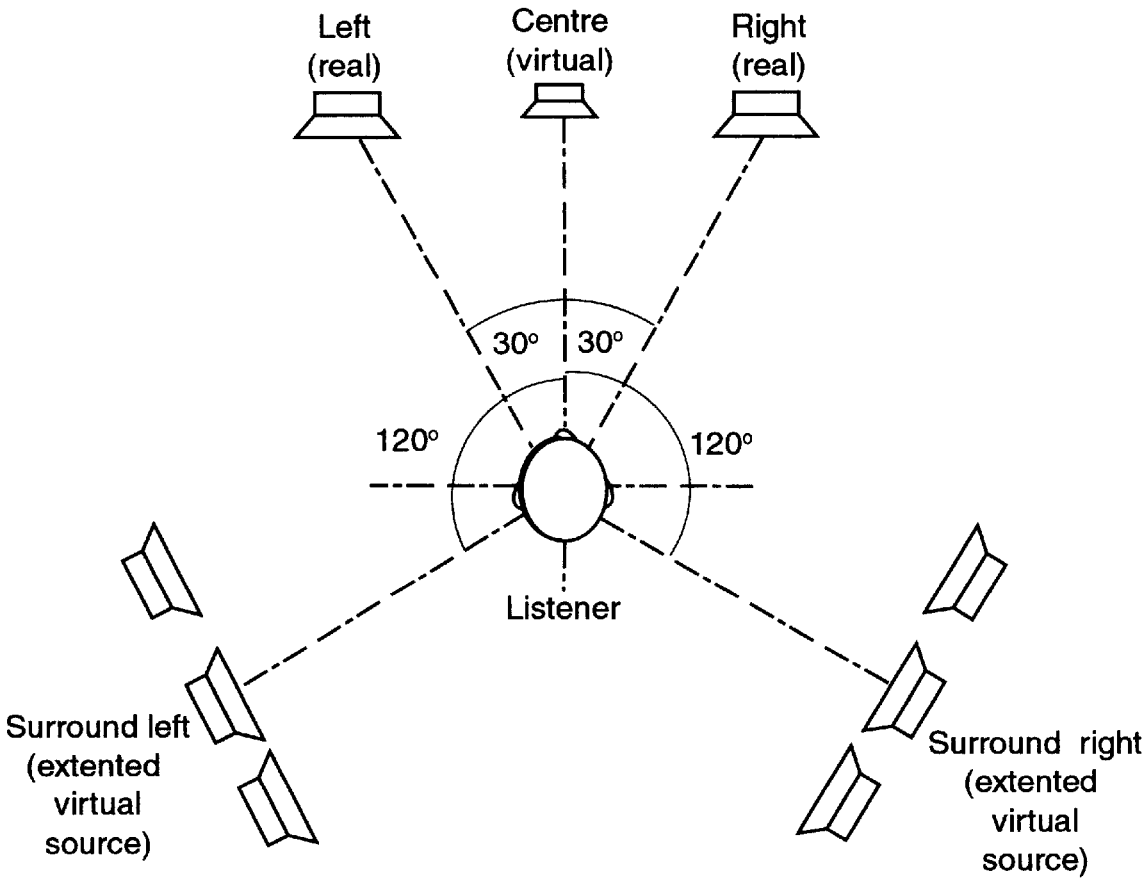

Embodiments of the invention will now be described, by way of example only, with reference to the accompanying diagrammatic drawings, in which FIG. 1 shows a prior art method of synthesising an audio signal, FIG. 2 shows a real extended sound source, FIG. 3 shows a second real extended sound source, FIG. 4 shows a block diagram of methods of synthesis for a) headphone and b) loudspeaker reproduction, FIG. 5 shows an extended sound source at different distances from a listener, FIG. 6 shows a block diagram of a first embodiment according to the invention, FIG. 7 shows a comb filter and its characteristics, FIG. 8 shows a pair of complimentary comb filter characteristics, FIG. 9 shows a triplet sound source using complimentary comb filters, FIG. 10 shows a second embodiment according to the invention, FIG. 11 shows a third embodiment according to the invention, FIG. 12 shows the recreation of the sound source of FIG. 2, FIG. 13 shows a fourth embodiment of the invention, FIG. 14 shows a schematic diagram of a known method of simulating a multichannel surround sound system, and FIG. 15 shows a method of simulating a multichannel surround sound system according to the present invention.

The present invention relates particularly to the reproduction of 3D-sound from two-speaker stereo systems or headphones. This type of 3D-sound is described, for example, in EP-B-0689756 which is incorporated herein by reference.

It is well known that a mono sound source can be digitally processed via a pair of "Head-Response Transfer Functions" (HRTFs), such that the resultant stereo-pair signal contains 3D-sound cues. These sound cues are introduced naturally by the head and ears when we listen to sounds in real life, and they include the inter-aural amplitude difference (IAD), inter-aural time difference (ITD) and spectral shaping by the outer ear. When this stereo signal pair is introduced efficiently into the appropriate ears of the listener, by headphones say, then he or she perceives the original sound to be at a position in space in accordance with the spatial location of the HRTF pair which was used for the signal-processing.

When one listens through loudspeakers instead of headphones, then the signals are not conveyed efficiently into the ears, for there is "transaural acoustic crosstalk" present which inhibits the 3D-sound cues. This means that the left ear hears a little of what the right ear is hearing (after a small, additional time-delay of around 0.2 ms), and vice versa. In order to prevent this happening, it is known to create appropriate "crosstalk cancellation" signals from the opposite loudspeaker. These signals are equal in magnitude and inverted (opposite in phase) with respect to the crosstalk signals, and designed to cancel them out. There are more advanced schemes which anticipate the secondary (and higher order) effects of the cancellation signals themselves contributing to secondary crosstalk, and the correction thereof, and these methods are known in the prior art.

When the HRTF processing and crosstalk cancellation are carried out correctly, and using high quality HRTF source data, then the effects can be quite remarkable. For example, it is possible to move the virtual image of a soundsource around the listener in a complete horizontal circle, beginning in front, moving around the right-hand side of the listener, behind the listener, and back around the left-hand side to the front again. It is also possible to make the sound source move in a vertical circle around the listener, and indeed make the sound appear to come from any selected position in space. However, some particular positions are more difficult to synthesise than others, some for psychoacoustic reasons, we believe, and some for practical reasons.

For example, the effectiveness of sound sources moving directly upwards and downwards is greater at the sides of the listener (azimuth=90°) than directly in front (azimuth=0°). This is probably because there is more left-right difference information for the brain to work with. Similarly, it is difficult to differentiate between a sound source directly in front of the listener (azimuth=0°) and a source directly behind the listener (azimuth=180°). This is because there is no time-domain information present for the brain to operate with (ITD=0), and the only other information available to the brain, spectral data, is similar in both of these positions. In practice, there is more HF energy perceived when the source is in front of the listener, because the high frequencies from frontal sources are reflected into the auditory canal from the rear wall of the concha, whereas from a rearward source, they cannot diffract around the pinna sufficiently to enter the auditory canal effectively.

In practice, it is known to make measurements from an artificial head in order to derive a library of HRTF data, such that 3D-sound effects can be synthesised. It is common practice to make these measurements at distances of 1 meter or thereabouts, for several reasons. Firstly, the sound source used for such measurements is, ideally, a point source, and usually a loudspeaker is used. However, there is a physical limit on the minimum size of loudspeaker diaphragms. Typically, a diameter of several inches is as small as is practical whilst retaining the power capability and low-distortion properties which are needed. Hence, in order to have the effects of these loudspeaker signals representative of a point source, the loudspeaker must be spaced at a distance of around 1 meter from the artificial head. Secondly, it is usually required to create sound effects for PC games and the like which possess apparent distances of several meters or greater, and so, because there is little difference between HRTFs measured at 1 meter and those measured at much greater distances, the 1 meter measurement is used.

The effect of a sound source appearing to be in the mid-distance (1 to 5 m, say) or far-distance (>5 m) can be created easily by the addition of a reverberation signal to the primary signal, thus simulating the effects of reflected sound waves from the floor and walls of the environment. A reduction of the high frequency (HF) components of the sound source can also help create the effect of a distant source, simulating the selective absorption of HF by air, although this is a more subtle effect. In summary, the effects of controlling the apparent distance of a sound source beyond several meters are known.

Alternatively, in many PC games situations it is desirable to have a sound effect appear to be very close to the listener. For example, in an adventure game, it might be required for a "guide" to whisper instructions into one of the listener's ears, or alternatively, in a flight-simulator, it might be required to create the effect that the listener is a pilot, hearing air-traffic information via headphones. In a combat game, it might be required to make bullets appear to fly close by the listener's head. These effects are not possible solely using HRTFs measured at 1 meter distance, but they can be synthesised from 1 meter HRTFs by additional signal-processing to recreate appropriate differential L-R sound intensity values, as is described in our co-pending patent application GB9726338.8 which is incorporated herein by reference.

In all of the prior art, the virtual sound sources are created and represented by means of a single point source. At this stage, it is worth defining what is meant here, in the present document, by the expression "virtual sound source". A virtual sound source is a perceived source of sound synthesised by a binaural (two-channel) system (i.e. via two loudspeakers or by headphones), which is representative of a sound-emitting entity such as a voice, a helicopter or a waterfall, for example. The virtual sound source can be complemented and enhanced by the addition of secondary effects which are representative of a specified virtual environment, such as sound reflections, echoes and absorption, thus creating a virtual sound environment.

The present invention comprises a means of 3D-sound synthesis for creating virtual sound images with improved realism compared to the prior art. This is achieved by creating a virtual sound source from a plurality of virtual point sources, rather than from a single, point source as is presently done. By distributing said plurality of virtual sound sources over a prescribed area or volume relating to the physical nature of the sound-emitting object which is being synthesised, a much more realistic effect is obtained because the synthesis is more truly representative of the real physical situation. The plurality of virtual sources are caused to maintain constant relative positions, and so when they are made to approach or leave the listener, the apparent size of the virtual sound-emitting object changes just as it would if it were real.

One aspect of the invention is the ability to create a virtual sound source from a plurality of dissimilar virtual point sources. Again, this is representative of a real-life situation, and the result is to enhance the realism of a synthesised virtual sound image.

Finally, it is worth noting that there is a particular, relevant effect which occurs when synthesising 3-D sound which must be taken into account. When synthesising several virtual sound sources from a single, common source, then there is a large common-mode content present between left and right channels. This can inhibit the ability of the brain of a listener to distinguish between the various virtual sounds which derive from the same source. Similarly, if a pair (or other even number) of virtual sounds are to be synthesised in a symmetrical configuration about the median plane (the vertical plane which bisects the head of the listener, running from front to back), then the symmetry enhances the correlation between the individual sound sources, and the result is that the perceived sounds can become "fused" together into one. A means of preventing or reducing this effect is to create two or more decorrelated sources from any given single source, and then to use the decorrelated sounds for the creation of the virtual sources.

Hence, the invention encompasses three main ways to create a realistic sound image from two or more virtual point sources of sound:

(a) where the plurality of point sources are similar, but the different HRTF processing applied to them decorrelates them sufficiently so as to be separately distinguishable without further decorrelation;

(b) where a decorrelation method is used to create a plurality of sound sources from a single original sound source (this is especially useful where the sounds are to be placed symmetrically about the median plane);

(c) where the plurality of sounds are derived from different sources, each representative of an element of the real-life sound source which is being simulated.

The emission of sound is a complex phenomenon. For any given sound source, one can consider the acoustic energy as being emitted from a continuous, distributed array of elemental sources at differing locations, and having differing amplitudes and phase relationships to one another. If one is sufficiently far enough from such a complex emitter, then the elemental waveforms from the individual emitters sum together, effectively forming a single, composite wave which is perceived by the listener. It is worth defining several different types of distributed emitter, as follows.

Firstly, a point source emitter. In reality, there is no such thing as a point source of acoustic radiation: all sound-emitting objects radiate acoustic energy from a finite surface area (or volume), and it will be obvious that there exists a wide range of emitting areas. For example, a small flying insect emits sound from its wing surfaces, which might be only several square millimeters in area in practise, the insect could almost be considered as a point source, because, for all reasonable distances from a listener, it is clearly perceived as such.

Secondly, a line source emitter. When considering a vibrating wire, such as a resonating guitar string, the sound energy is emitted from a (largely) two dimensional object: it is, effectively, a "line" emitter. The sound energy per unit length has a maximum value at the antinodes, and minimum value at the nodes. An observer close to a particular string antinode would measure different amplitude and phase values with respect to other listeners who might be equally close to the string, but at different positions along its length, near, say, to a node or the nearest adjacent antinode. At a distance, however, the elemental contributions add together to form a single wave, although this summation varies with spatial position because of the differing path lengths to the elemental emitters (and hence differing phase relationships).

Thirdly, an area source emitter. A resonating panel is a good example of an area source. As for the guitar string, however, the area will possess nodes and antinodes according to its mode of vibration at any given frequency, and these summate at sufficient distance to form, effectively, a single wave.

Fourthly, a volume source emitter. In contrast to the insect "point source", a waterfall cascading on to rocks might emit sound from a volume which is thousands of cubic meters in size: the waterfall is a very large volume source. However, if it were a great distance from the listener (but still within hearing distance), it would be perceived as a point source. In a volume source, some of the elemental sources might be physically occluded from the listener by absorbing material in the bulk of the volume.

In a practical situation, what are the important issues in deciding whether a real, distributed emitter can be considered to be a point source, or whether it should be synthesised as a more complex, distributed source? The factor which distinguishes whether a perceived sound source is similar Lo a point source or not is the angle subtended by the sound-emitting area at the head of the listener. In practical terms, this is related to our ability to perceive that an emitting object has an apparent significant size greater than the smallest practical point source, such as the insect. It has been shown by A W Mills (J. Acoust. Soc. Am. 1958 vol 30, issue 4, pages 237–246) that the "minimum audible angle" corresponds to an inter-aural time delay (ITD) of approximately 10 $\mu$s, which is equivalent to an incremental azimuth angle of about 1.5° (at 0° azimuth and elevation). In practical terms, we have found it appropriate to use an incremental azimuth unit of 3°, because this is sufficiently small as to be almost indiscernible when moving a virtual sound source from one point to another, and also the associated time delay corresponds approximately to one sample period (at 44.1 kHz frequency). However, these values relate to differential positions of a single sound source, and not to the interval between two concurrent sources.

From experiments, the inventor believes that a sensible method for differentiating between a point source and an area source would be the magnitude of the subtended angle at the listener's head, using a value of about 20° as the criterion. Hence, if a sound source subtends an angle of less than 20° at the head of the listener, then it can be considered to be a point source; if it subtends an angle larger than 20°, then it is not a point source.

As an extension of the principle of synthesizing a virtual sound source from a plurality of sound sources where the sources derive from one original source, such as a .WAV computer file, an alternative approach exists where the sound sources may be different to each other. This is a powerful method of creating a virtual image of a large, complex sound-emitting object such as a helicopter, where a number of individual sources can be identified. For example, FIG. 2 shows a diagram of a helicopter showing several primary sound sources, namely the main blade tips, the exhaust, and the tail rotor. Similarly, FIG. 3 shows a truck with the main sound-emitting surfaces similarly marked: the engine block, the tires and the exhaust. In both cases it would be advantageous to create a composite sound image of the object by means of a plurality of individual virtual sound sources: one for the exhaust, one for the rotor, and so on. In a computer game application, the game itself links the individual sources geometrically, such that when they are relatively dislant to the listener, they are effectively superimposed on each other, but when they are close up, they are physically separated according to the pre-arranged selected geometry and spatial positions. An important consequence of this is that a virtual sound source which is thus created scales with distance: it appears to increase in size when it approaches, and diminishes when it goes away from the listener. Also, when this sound source is caused to be "close" to the listener, it appears convincingly so, unlike prior-art systems where a point source would be used to create a virtual image of all objects, irrespective of their physical size or the angle which they should subtend at the preferred position of the listener.

FIG. 1 shows a block diagram of the HRTF-based signal-processing method which is used to create a virtual sound source from a mono sound source (such as a sound recording, or via a computer from a .WAV file or similar). The methods are well documented in the prior art, such as for example FP-B-0689756. FIG. 1 shows that left- and right-channel output signals are created, which, when transmitted to the left and right ears of a listener, create the effect that the sound source exists at a point in space according to the chosen HRTF characteristics, as specified by the required azimuth and elevation parameters.

FIG. 4 shows known methods for transmitting the signals to the left and right ears of a listener, first, by simply using a pair of headphones (via suitable drivers), and secondly, via loudspeakers, in conjunction with transaural crosstalk cancellation processing, as is fully described in WO 95/15069.

Consider, now, for example, the situation where it is required to create the effect of a large truck passing the listener at differing distances, as depicted in FIG. 5. At a distance, a single point source is sufficient to simulate the truck. However, at close range, the engine enclosure panels emit sound energy from an area which subtends a significant area at the listener's head, as shown, and it is appropriate to use a plurality of virtual sources, as shown schematically in FIG. 6. (FIG. 6 also shows the crosstalk cancellation processing appropriate for loudspeaker listening, as described above.)

In many circumstances, especially when virtual sound effects are to be recreated to the sides of the listener, the HRTF processing decorrelates the individual signals sufficiently such that the listener is able to distinguish between them, and hear them as individual sources, rather than "fuse" them into apparently a single sound. However, when there is symmetry in the placement of the individual sounds (say, one is to be placed at −30° azimuth in the horizontal plane, and another is to be placed at +30°), then our hearing processes cannot distinguish them separately, and create a vague, centralised image.

This is consistent with reality, where the individual elemental sources which make up a large area sound source all possess differing amplitude and phase characteristics, whereas in practise, we are often obliged to use a single sound recording or computer file to create the plurality of virtual sources for the sake of economy of storage and processing. Consequently, there is an unrealistically high correlation between the resultant array of virtual sources. Hence, in order to improve the effectiveness of the invention, there is preferably provided the ability to decorrelate the individual signals. In order to minimize the signal processing requirements (and minimize costs and processing complexity), it is advantageous to use simple methods. The following method has been found to be an example of an effective, simple means of decorrelation, applicable to the present invention.

A signal can be decorrelated sufficiently for the present invention by means of comb-filtering. This method of filtering is known in the prior art, but has not been applied to 3D-sound synthesis methods to the best of the applicants knowledge. FIG. 7 shows a simple comb filter, in which the source signal, S, is passed through a time-delay element, and an attenuator element, and then combined with the original signal, S. At frequencies where the time-delay corresponds to one half a wavelength, the two combining waves are exactly 180° out of phase, and cancel each other, whereas when the time delay corresponds to one whole wavelength, the waves combine constructively. If the amplitudes of the two waves are the same, then total nulling and doubling, respectively, of the resultant wave occurs. By attenuating one of the combining signals, as shown, then the magnitude of the effect can be controlled. For example, if the time delay is chosen to be 1 ms, then the first cancellation point exists at 500 Hz. The first constructive addition frequency points are at 0 Hz, and 1 kHz, where the signals are in phase. If the attenuation factor is set to 0.5, then the destructive and constructive interference effects are restricted to −3 dB and +3 dB respectively. These characteristics are shown in FIG. 7 (lower), and have been found useful for the present purpose It might often be required to create a pair of decorrelated signals. For example, when a large sound source is to be simulated in front of the listener, extending laterally to the left and right, a pair of sources would be required for symmetrical placement (e.g. −40° and +40°), but with both sources individually distinguishable. This can be done efficiently by creating and using a pair of complementary comb filters. This is achieved, firstly, by creating an identical pair of filters, each as shown according to FIG. 7 (and with identical time delay values), but with signal inversion in one of the attenuation pathways. Inversion can be achieved either by (a) changing the summing node to a "differencing" node (for signal subtraction), or (b) inverting the attenuation coefficient (e.g. from +0.5 to −0.5); the end result is the same in both cases. The outputs of such a pair of complementary filters exhibit maximal amplitude decorrelation within the constraints of the attenuation factors, because the peaks of one correspond to the troughs of the other (FIG. 8), and vice versa.

If a source "triplet" were required, then a convenient method of creating such an arrangement is shown in FIG. 9, where a pair of maximally decorrelated sources are created, and then used in conjunction with the original source itself, thus providing three decorrelated sources.

Accordingly, a general system for creating a plurality of n point sources from a sound source is shown in FIG. 10. In such a situation, it can be inefficient to reproduce the low-frequency (LF) sound components from all of the elemental sound sources because (a) LF sounds can not be "localised" by human hearing systems, and (b) LF sounds from a real source will be largely in phase (and similar in amplitude) for each of the sources. In order to avoid spurious LF cancellation, it might be advantageous to supply the LF via the primary channel, and apply LF cut filters to the decorrelation channels (FIG. 11).

As mentioned previously, many real-world sound sources can be broken down into an array of individual, differing sounds. For example, a helicopter generates sound from several sources (as shown previously in FIG. 2), including the blade tips, the exhaust, and the tail-rotor. If one were to create a virtual sound source representing a helicopter using only a point source, it would appear like a recording of a helicopter being replayed through a small, invisible loudspeaker, rather than a real helicopter. If, however, one uses the present invention to create such an effect, it is possible to assign various different virtual sounds for each source (blade tips, exhaust, and so on), linked geometrically in virtual space to create a composite virtual source (FIG. 12), such that the effect is much more vivid and realistic. The method is shown schematically in FIG. 13. There is a significant added benefit in doing this, because when the virtual object draws near, or recedes, the array of virtual sound sources similarly appear to expand and contract accordingly, which further adds to the realism of the experience. In the distance, of course, the sound sources can be merged into one, or replaced by a single point source.

The present invention may be used to simulate the presence of an array of rear speakers or "diffuse" speaker for sound effects in surround sound reproduction systems, such as for example, THX or Dolby Digital (AC3) reproduction. FIGS. 14 and 15 show schematic representations of the synthesis of virtual sound sources to simulate real multichannel sources, FIG. 14 showing virtual point sound sources and FIG. 15 showing the use of a triplet of decorrelated point sound sources to provide an extended area sound source as described above.

Although in the above embodiments all the Figures show the presence of transaural crosstalk cancellation signal processing, this can be omitted if reproduction over headphones is required.

Finally, the content of the accompanying abstract is hereby incorporated into this description by reference.

What is claimed is:

1. A method of synthesizing an audio signal having an appearance of being emitted from a region of space having a non-zero extent in one or more dimensions, comprising:

providing a respective single channel signal for each of a plurality of point sound sources, said plurality of point sound sources together forming a virtual sound source;

defining spatial relationships of said plurality of point sound sources relative to each another;

selecting an apparent location for each of said plurality of point sound sources relative to a preferred position of a listener at a given time;

processing said respective single channel signal for each of said plurality of point sound sources to provide a left channel signal and a right channel signal for each of said plurality of point sound sources, said left channel signal and said right channel signal including cues for perception of at least one of an apparent direction and a relative position of said each of said plurality of point sound sources with respect to said preferred position of said listener; and combining each of said plurality of left channel signals together and each of said plurality of right channel signals together to provide said audio signal having a left channel and a right channel corresponding to the said virtual sound source.

2. The method of synthesizing an audio signal in accordance with claim 1, further comprising:

receiving a first signal corresponding to a first one of said plurality of point sound sources and a second signal corresponding to a second one of said plurality of point sound sources, said first signal and said second signal being substantially identical; and modifying at least one of said first signal and said second signal to be sufficiently different from each another, and to be distinguishable by said listener when said first and second one of said plurality of point sound sources are disposed symmetrically on opposite sides of said preferred position of said listener.

3. The method of synthesizing an audio signal in accordance with claim 2, wherein:

said step of receiving said first signal and said second signal and said step of modifying said first signal and said second signal are performed before said step of processing said respective single channel signal for each of said plurality of point sound sources.

4. The method of synthesizing an audio signal in accordance with claim 2, wherein:

said step of modifying at least one of said first signal and said second signal comprises:

filtering at least one of said first signal and said second signal using at least one de-correlation filter.

5. The method of synthesizing an audio signal in accordance with claim 3, wherein:

said step of modifying at least one of said first signal and said second signal comprises:

filtering at least one of said first signal and said second signal using at least one de-correlation filter.

6. The method of synthesizing an audio signal in accordance with claim 4, wherein:

said at least one de-correlation filter comprises at least one comb filter.

7. The method of synthesizing an audio signal in accordance with claim 5, wherein:

said at least one de-correlation filter comprises at least one comb filter.

8. The method of synthesizing an audio signal in accordance with claim 1, wherein:

said respective single channel signal for each of said plurality of point sound sources represents a sound traveling directly from said apparent location of respective one of said plurality of point sound sources with respect to said preferred position of said listener.

9. The method of synthesizing an audio signal in accordance with claim 1, wherein:

said step of processing said respective single channel signal for each of said plurality of point sound sources comprises:

providing a left channel and a right channel each having an identical signal corresponding to a respective one of said plurality of point sound sources;

modifying each of said left channel and said right channel using at least one head related transfer function to provide a left signal for the left ear of said listener in said left channel and a right signal for the right ear of said listener in said right channel; and introducing a time delay between said left channel and said right channel corresponding to an inter-aural time difference for said signal coming corresponding said respective one of said plurality of point sound sources.

10. The method of synthesizing an audio signal in accordance with claim 1, further comprising:

compensating said left channel and said right channel of said audio signal to reduce transaural crosstalk when said audio signal is to be replayed by loudspeakers remote from said listener's ears.

11. The method of synthesizing an audio signal in accordance with claim 1, further comprising:

combining said audio signal with at least one other signal having two or more channels.

12. The method of synthesizing an audio signal in accordance with claim 1, further comprising:

combining each of left channel and right channel of said audio signal with contents of corresponding channels of at least one other signal having two or more channels to provide a new combined signal having two channels.

13. The method of synthesizing an audio signal in accordance with claim 1, further comprising:

selecting said apparent locations for said plurality of point sound sources relative to said preferred position of said listener to change with time to provide the impression of movement of said virtual sound source.

14. An apparatus synthesizing an audio signal having an appearance of being emitted from a region of space having a non-zero extent in one or more dimensions, comprising:

means for providing a respective single channel signal for each of a plurality of point sound sources, said plurality of point sound sources together forming a virtual sound source;

means for defining spatial relationships of said plurality of point sound sources relative to each another;

means for selecting an apparent location for each of said plurality of point sound sources relative to a preferred position of a listener at a given time;

means for processing said respective single channel signal for each of said plurality of point sound sources to provide a left channel signal and a right channel signal for each of said plurality of point sound sources, said left channel signal and said right channel signal including cues for perception of at least one of an apparent direction and a relative position of said each of said plurality of point sound sources with respect to said preferred position of said listener; and means for combining each of said plurality of left channel signals together and each of said plurality of right channel signals together to provide said audio signal having a left channel and a right channel corresponding to the said virtual sound source.

15. An audio signal having an appearance of being emitted from a region of space having a non-zero extent in one or more dimensions, comprising:

a right signal for a right ear of a listener, said right signal being obtained by combining together a plurality of right channel signals corresponding to respective ones of a plurality of point sound sources; and a left signal for a left ear of said listener, said left signal being obtained by combining together a plurality of left channel signals corresponding to said respective ones of said plurality of point sound sources;

wherein each of said plurality of point sound sources having an apparent location relative to a preferred position of a listener at a given time, said plurality of point sound sources together forming a virtual sound source, and wherein each of said plurality of left channel signals and each of said plurality of right channel signals include cues for perception of at least one of an apparent direction and a relative position of corresponding one of said plurality of point sound sources with respect to said preferred position of said listener.

* * * * *